United States Patent [19]

Spaunhorst

[11] Patent Number: 4,517,544

[45] Date of Patent: May 14, 1985

[54] TIME DELAY ELECTRIC FUSE

[75] Inventor: Vernon R. Spaunhorst, Washington, Mo.

[73] Assignee: McGraw-Edison Company, Rolling Meadows, Ill.

[21] Appl. No.: 545,041

[22] Filed: Oct. 24, 1983

[51] Int. Cl.[3] ..... H01H 85/04

[52] U.S. Cl. ..... 337/164; 337/166; 337/293

[58] Field of Search ..... 337/164, 163, 166, 161, 337/293

[56] References Cited

U.S. PATENT DOCUMENTS

| | | | |
|---|---|---|---|
| 3,267,238 | 8/1966 | Arikawa et al. | 337/164 |
| 3,268,691 | 8/1966 | Fitzgerald | 337/161 |
| 3,845,439 | 10/1974 | Deelman | 337/291 |
| 3,858,142 | 12/1974 | Deelman | 337/152 |
| 3,869,689 | 3/1975 | Kasamatu | 337/164 |
| 4,057,774 | 11/1977 | Arikawa et al. | 337/164 |
| 4,177,444 | 12/1979 | Taki | 337/163 |
| 4,237,440 | 12/1980 | Miyasaka et al. | 337/227 |

*Primary Examiner*—Harold Broome

*Attorney, Agent, or Firm*—John S. Paniaguas; Charles W. MacKinnon; Jon Carl Gealow

[57] ABSTRACT

A time delay fuse includes a tubular housing of insulative material with first and second open ends. First and second metallic or electrically conductive ferrules are mounted on the first and second ends, respectively, of the tubular housing. A core is positioned within the tubular housing and affixed to the ferrules by electrically conductive material such as solder. At least one short inner wire extends along the core and is electrically and mechanically connected to the solder. A second wire, longer than the first wire, is spirally wound around the core and the first inner wire. The second wire includes first and second ends mechanically and electrically connected to the conductive material such that the first and second wires are electrically parallel.

18 Claims, 6 Drawing Figures

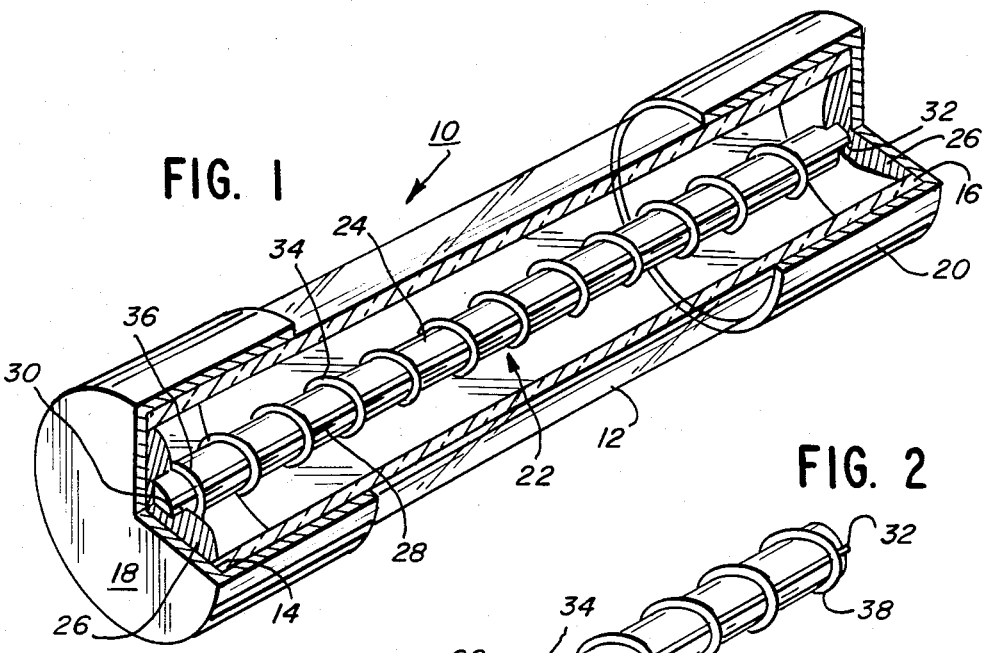
FIG. 1
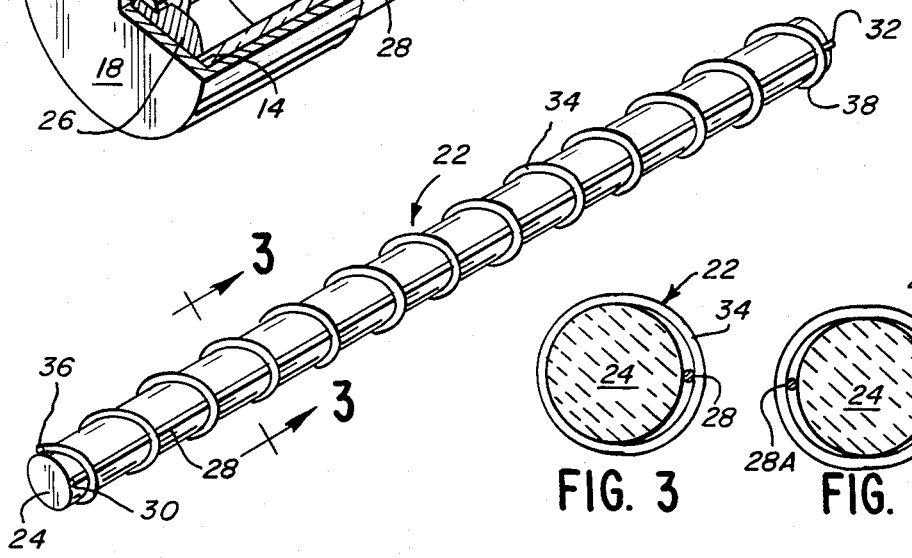
FIG. 2
FIG. 3
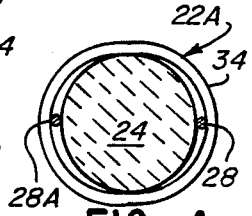
FIG. 4
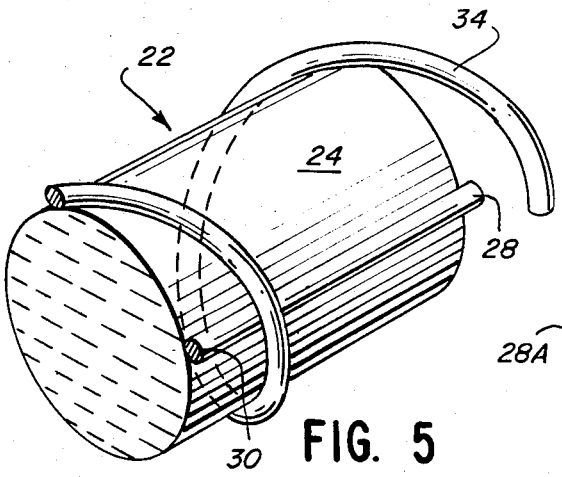
FIG. 5
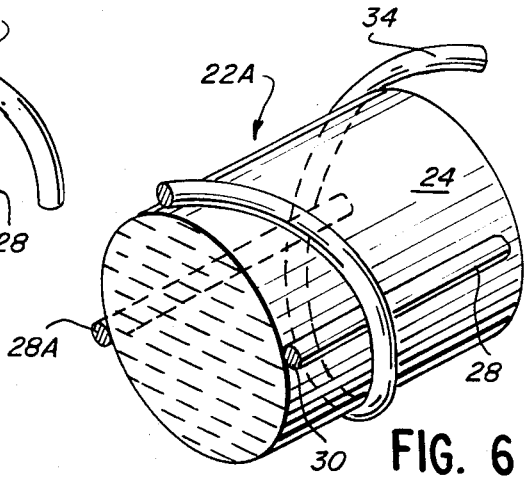
FIG. 6

TIME DELAY ELECTRIC FUSE

BACKGROUND OF THE INVENTION

The present invention relates to a new and improved electric fuse for protection of circuits and more particularly to a time delay fuse having improved short circuit performance and reduced operating temperature.

Time delay fuses are characterized by permitting an overload in-rush or surge current to flow through the fuse without interrupting the circuit or clearing the fuse. Such fuses, however, will clear in response to relatively moderate constant current overloads.

Time delay fuses are important for protecting circuits for various types of motors, radio and television receivers and other electrical and electronic devices which experience large surge currents when a power source is connected to energize the device. Shortly after connection to a power source, these devices typically reach normal operating conditions and use a relatively steady flow of normal current considerably lower than the surge current. In such a device, it is not desirable for the fuse to clear too quickly when the power source is applied, but rather a delay should be provided before clearing.

There have been several attempts to design suitable time delay fuses. For example, U.S. Pat. No. 3,869,689 discloses a fuse including an insulated wire closely wrapped around a resistance wire. Melting insulation plays a role in the performance of this fuse. The difficulties in controlling melting of insulation results in a somewhat less predictable fuse operation.

Another time delay fuse is illustrated in U.S. Pat. No. 4,237,440. The fuse disclosed in this patent includes two cores of insulating material with a figure eight configuration. Time delay is obtained by increasing the diameter and the length of the single wire. However, the process of braiding a single wire around a pair of cores is cumbersome, difficult and relatively expensive.

A fuse defined by a wire wrapped on another wire is illustrated in U.S. Pat. No. 3,267,238. The two wires are of dissimilar materials and one wire is wrapped around the other to provide continuous contact between the two wires. The first wire is of high resistance and low coefficient of thermal expansion, and the second is of a low resistance thereby providing a delaying effect. However, the use of these two coated dissimilar wires increases the complexity and cost of the fuse.

In U.S. Pat. No. 4,057,774, a fusible wire is wrapped by a second wire and the resultant wrapped wire is spirally wound over a highly heat conductive rod-like member which acts as a heat sink to provide time delay. Such a device may also be difficult to manufacture thereby increasing the cost.

A time delay fuse with a single wire wrapped around a glass fiber core is illustrated in U.S. Pat. No. 4,177,444. A similar winding of a single wire about a fiber core is illustrated in U.S. Pat. No. 3,845,439. A very thin single silver wire wrapped around a core is illustrated in U.S. Pat. No. 3,858,142, and a similar fuse is illustrated in U.S. Pat. No. 4,189,696. A fuse including a single wire wrapped around a core, but with the spacing of the coils of the wire varied as illustrated in U.S. Pat. No. 4,034,329. A similar fuse but with a cruciform cross section in combination with an indicating fuse is illustrated in U.S. Pat. No. 3,614,699. Fuses including a single coated or bare wire wrapped around a core are also illustrated in U.S. Pat. No. 1,629,266, and British Patent Specification No. 77,125. The basic principal of operation of element designs which incorporate a single wire wrapped onto a core is that the time delay is obtained by increasing the length and diameter of the wire and therefore the mass. However, this tends to adversly affect short circuit performance.

SUMMARY OF THE INVENTION

An object of the present invention is to provide a new and improved time delay fuse.

Another object of the present invention is to provide a new and improved fuse with improved short circuit performance.

A still further object of the present invention is to provide a new and improved fuse with reduced operating temperatures.

A still further object of the present invention is to provide a new and improved time delay fuse which is easily manufactured at a reasonable cost.

Briefly, the present invention is directed to a new and improved time delay fuse including a tubular housing fabricated of insulative material. The housing includes first and second open ends. First and second ferrules are mounted on the first and second ends, respectively. An elongated, cylindrical ceramic core with a first short wire running along its length is positioned within the tubular housing and held by the ends thereof to each of the ferrules by electrically conductive material such as solder. A second longer wire is spirally wrapped around the core and the first wire with its ends mounted in the solder so as to be electrically in parallel with the first wire. The first short wire reduces the resistance of the fuse thereby reducing its operating temperature. The use of the short wire allows a reduction in wire size of the second spirally wound wire resulting in improved short circuit performance of the fuse.

The above and other objects and advantages and novel features of the present invention will become apparent from the following detailed description of a preferred embodiment of the invention illustrated in the accompanying drawing.

BRIEF DESCRIPTION OF THE DRAWINGS

FIG. 1 is a perspective, partially cut away view of a fuse constructed in accordance with the principles of the present invention;

FIG. 2 is a perspective view of the fuse element of the fuse of the present invention;

FIG. 3 is a view taken along line 3—3 of FIG. 2;

FIG. 4 is a view similar to FIG. 3 of an alternative embodiment of the present invention;

FIG. 5 is an enlarged, partially cut away, perspective view of the fuse element of the present invention;

FIG. 6 is a view similar to FIG. 5 of an alternative embodiment of the fuse of the present invention.

DETAILED DESCRIPTION OF THE PREFERRED EMBODIMENT

Referring to the drawing and initially to FIG. 1, there is illustrated a time delay fuse generally designated by the reference numeral 10. Fuse 10 is of the type included in circuits which may experience large inrush or surge currents for brief periods of time, during initial connection of a source of electrical power to a device or circuit. Such fuses are often employed, with devices such as motors, radio or television receivers, or other electronic devices. Fuse 10 is illustrated as a cartridge fuse, however, it is to be understood that the principles of the present invention are not limited to this specific type of fuse and other fuses employing time delay features may include the present invention.

Fuse 10 includes a tubular housing 12 with a first open end 14, and a second open end 16. Housing 12 may be fabricated of any insulative material, such as glass, and although illustrated as cylindrical, other shapes may be used.

First end 14 of housing 12 is covered and closed by a first metallic ferrule 18 which is fabricated from a electrical conductive material. Similarly, second end 16 of housing 12 is closed and covered by a second ferrule 20, generally fabricated of the same material as ferrule 18.

Mounted within housing 12 between first ferrule 18 and second ferrule 20 is a fuse element generally designated by the reference numeral 22. Fuse element 22 includes an elongated cylindrical core 24 made of an electrically insulative material of low thermal conductivity, such as a ceramic or a material with similar thermal characteristics. Core 24 is illustrated as cylindrical in configuration; however, other shapes may be employed without exceeding the bounds of the present invention. Core 24 may be rigid or flexible. Core 24 is mechanically secured to first ferrule 18 and second ferrule 20 by an electrically conductive material 26 which may be solder or a similar material.

Fuse element 22 includes a first short, straight uninsulated wire 28 extending along the length of core 24. First wire 28 includes a first end 30 and a second end 32 which are each embedded in conductive material 26 thereby providing an electrical connection between first ferrule 18 and second ferrule 20 through first wire 28.

A second, longer, uninsulated wire 34 of a larger diameter than first wire 28 is spirally wrapped around core 24 and first short wire 28. The spiral wrapping of the second wire 34 tightly secures first wire 28 to core 24 and establishes several point contacts between first wire 28 and second wire 34 at the points where they touch. The time delay feature of fuse 10 is provided in part by second long wire 34. Wire 34 also acts as a heat sink at the points of contact with the first wire 28.

Second wire 34 includes a first end 36 and a second end 38 each also embeded in the conductive material 26 providing an electrical connection between first ferrule 18 and second ferrule 20 through wire 34 and placing second wire 34 electrically in parallel with first wire 28. Core 24 serves to maintain the relative position of first wire 28 and second wire 34 within the tubular housing 12 to avoid undesirable contact between housing 12 and wires 28 and 34 as a result of thermal expansion and bowing.

Shorter wire 28, due to its relative length and lower resistance, generally carries approximately fifty percent (50%) or more of the current passing through fuse 10. The inclusion of first wire 28 reduces the resistance of fuse 10 relative to single wrapped wire fuses. Further, since temperature is proportional to current and resistance, the relative operating temperature of fuse 10 is also reduced compared to prior wrapped wire fuses.

The inclusion of short wire 28 also allows for a reduction in the size and, therefore, mass of wire 34 since the short wire 28 carries a large portion of the normal current load. Since short wire 28 allows a reduction in the size of longer wire 34, there is improved short circuit performance, as the overall mass of fuse wires 28 and 34 is relatively less than equivalent prior wrapped wire fuses and therefore less short circuit energy is required to clear fuse 10.

At some current ratings, it may be beneficial to provide a second short wire 28A (FIGS. 4 and 6), in addition to the first short wire 28. Wire 28A may be located at any point around the core in relation to short wire 28. Second short wire 28A also extends along the length of core 24 and is electrically and mechanically connected to conductive material 26 resulting in fuse element 22A with fuse wires 28, 28A and 34, all in electrical parallel. Additional short wires which extend along the length of core 24 may similarly be added to fuse element 22.

While several forms of time delay fuses disclosed herein constitute preferred embodiments, it should be understood that modifications thereof are within the scope and spirit of the invention disclosed and claimed.

I claim:

1. A time delay fuse comprising:

an insulative housing including first and second ends, first and second electrically conductive ferrules attached on said first and second ends of said housing, respectively, a fuse element including in combination, an elongated substantially straight electrically insulated core within said housing, at least one substantially straight wire extending along the external length of said core, a second longer wire being supported by said core and engaging said straight wire so as to establish a plurality of point contacts between said straight wire and said longer wire, and said straight and longer wires each being electrically connected in series with said conductive ferrules, said straight and longer wires each having a first end and a second end, wherein said first end of said straight wire and said first end of said longer wire each being electrically connected to said first ferrule and wherein said second end of said straight wire and said second end of said longer wire each being electrically connected to said second ferrule.

2. A fuse as set forth in claim 1, wherein said straight wire and said longer wire are connected at a plurality of contact points forming parallel current paths.

3. A fuse as set forth in claim 1, wherein said longer wire is of greater overall resistance than said straight wire.

4. A fuse as set forth in claim 1, further including a second straight wire extending along the length of said core.

5. A fuse as set forth in claim 1, wherein said core is substantially rigid.

6. A fuse as set forth in claim 1, wherein said core is flexible.

7. A fuse as set forth in claim 1, wherein said fuse element includes a plurality of straight wires extending along the external length of said core.

8. A time delay fuse comprising:

a housing of insulative material including first and second ends, first and second metallic terminals attached to said first and second ends of said housing, respectively, a fuse element including an electrically insulative, elongated, substantially straight core mounted between said metallic terminals within said housing, a first generally straight wire extending along the length of said core, and a second wire being spirally wrapped around said first wire and said core, thereby to assist in securing said first wire to said core and to establish a plurality of electrical contacts between said first wire and said second wire, said first and second wires being connected at a plurality of contact points forming parallel current paths, said first and second wires each having a first end and a second end, wherein said first end of said first wire and said first end of said second wire each being electrically connected to said first metallic terminal, and wherein said second end of said first wire and said second end of said second wire each being electrically connected to said second metallic terminal.

9. The fuse claimed in claim 8, wherein said second wire is of a larger diameter than said first wire.

10. The fuse claimed in claim 8, wherein said core is substantially rigid.

11. A fuse as claimed in claim 8, further comprising a third wire extending along the length of said core.

12. The fuse claimed in claim 8, wherein said second wire is of greater resistance than said first wire.

13. A time delay fuse comprising:

an insulative tubular housing having first and second generally circular ends, first and second metallic end caps attached to cover said first and second ends of said housing, respectively, a fuse element including an elongated, electrically insulative core element situated between said metallic ends within said housing, a substantially straigh first wire extending along the entire length of said core element, a second wire being helically wound around substantially the entire length of said first wire and said core element, thereby to assist in securing said first wire to said core element and to establish a plurality of electrical contacts between said first wire and said second wire, and said first and second wires each having a first end and a second end, wherein said first end of said first wire and said first end of said second wire each being electrically connected to said first metallic end cap and wherein said second end of said first wire and said second end of said second wire each being electrically connected to said second metallic end cap, said first wire and said second wire each being connected at a plurality of contact points forming parallel current paths.

14. A time delay fuse as set forth in claim 13, further comprising a third wire of approximately the same length as said first wire extending along the length of said core.

15. A time delay fuse as set forth in claim 13, wherein said core is substantially rigid.

16. A time delay fuse as set forth in claim 13, wherein said second wire is of a greater diameter than said first wire.

17. A time delay fuse as set forth in claim 13, wherein said first and second wires are bare.

18. A time delay fuse as set forth in claim 13, wherein said fuse element includes a plurality of wires extending substantially along the entire length of said core element.

* * * * *